US010358733B2

(12) United States Patent
Bardet et al.

(10) Patent No.: US 10,358,733 B2
(45) Date of Patent: Jul. 23, 2019

(54) ALUMINUM SMELTER AND METHOD TO COMPENSATE FOR A MAGNETIC FIELD CREATED BY THE CIRCULATION OF THE ELECTROLYSIS CURRENT OF SAID ALUMINUM SMELTER

(71) Applicant: Rio Tinto Alcan International Limited, Montréal (CA)

(72) Inventors: Benoit Bardet, Villargondran (FR); Steeve Renaudier, Saint Michel de Maurienne (FR)

(73) Assignee: Rio Tinto Alcan International Limited, Montreal (CA)

( * ) Notice: Subject to any disclaimer, the term of this patent is extended or adjusted under 35 U.S.C. 154(b) by 0 days.

(21) Appl. No.: 15/546,998

(22) PCT Filed: Feb. 5, 2016

(86) PCT No.: PCT/IB2016/000120
§ 371 (c)(1),
(2) Date: Jul. 27, 2017

(87) PCT Pub. No.: WO2016/128824
PCT Pub. Date: Aug. 18, 2016

(65) Prior Publication Data

US 2018/0023207 A1 Jan. 25, 2018

(30) Foreign Application Priority Data

Feb. 9, 2015 (FR) ..... 15 00251

(51) Int. Cl.
*C25C 3/16* (2006.01)
*C25C 3/20* (2006.01)

(52) U.S. Cl.
CPC . *C25C 3/16* (2013.01); *C25C 3/20* (2013.01)

(58) Field of Classification Search
CPC ..... C25C 3/16; C25C 3/20
See application file for complete search history.

(56) References Cited

U.S. PATENT DOCUMENTS 3,063,919 A 11/1962 Jouguet et al.
4,169,034 A 9/1979 Morel et al.
(Continued)

FOREIGN PATENT DOCUMENTS

EP 0204647 A1 12/1986
FR 1079131 A 11/1954
(Continued)

OTHER PUBLICATIONS

Apr. 28, 2016—International Search Report and Written Opinion of PCT/IB2016/000120.

*Primary Examiner* — Ciel P Thomas
(74) *Attorney, Agent, or Firm* — Banner & Witcoff, Ltd.

(57) ABSTRACT

This aluminum smelter comprises a line of electrolytic cells arranged transversely to the line, one of the cells comprising anode assemblies and electrical conductors mounted and connecting the anode assemblies. Rising and connecting conductors extend upwardly along two opposite longitudinal edges of the cell. In addition, the aluminum smelter comprises a first electrical compensating circuit extending under the cell and which can be traversed by a first compensating current in the opposite direction to that of the electrolysis current, a second electrical compensating circuit extending on one side of the line that can be traversed by a second compensating current in the same direction as the electrolysis current.

27 Claims, 5 Drawing Sheets

(56) References Cited

U.S. PATENT DOCUMENTS

Figure 1:
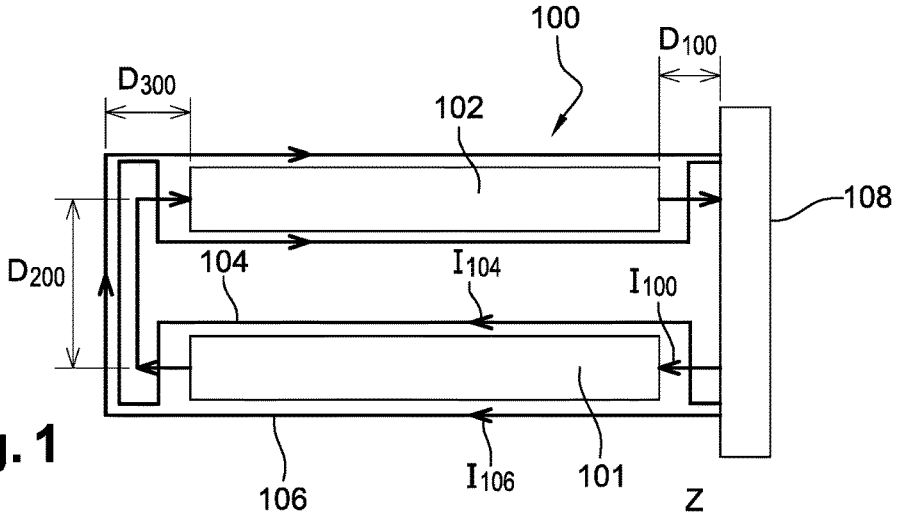

| | | | | |
|---|---|---|---|---|
| 4,397,728 | A | 8/1983 | Pfister et al. | |
| 4,713,161 | A | 12/1987 | Chaffy et al. | |
| 2007/0205099 | A1 | 9/2007 | Le Hervet et al. | |
| 2008/0041718 | A1* | 2/2008 | Pingin | C25C 3/16 204/242 |
| 2008/0078674 | A1* | 4/2008 | Platonov | C25C 3/16 204/279 |
| 2014/0138240 | A1 | 5/2014 | Martin et al. | |
| 2014/0138241 | A1 | 5/2014 | Duval et al. | |

FOREIGN PATENT DOCUMENTS

| | | | |
|---|---|---|---|
| FR | 2425482 | A1 | 12/1979 |
| FR | 2469475 | A1 | 5/1981 |
| FR | 2868436 | A1 | 10/2005 |
| WO | 2013007893 | A2 | 1/2013 |
| WO | 2015017924 | A1 | 2/2015 |

* cited by examiner

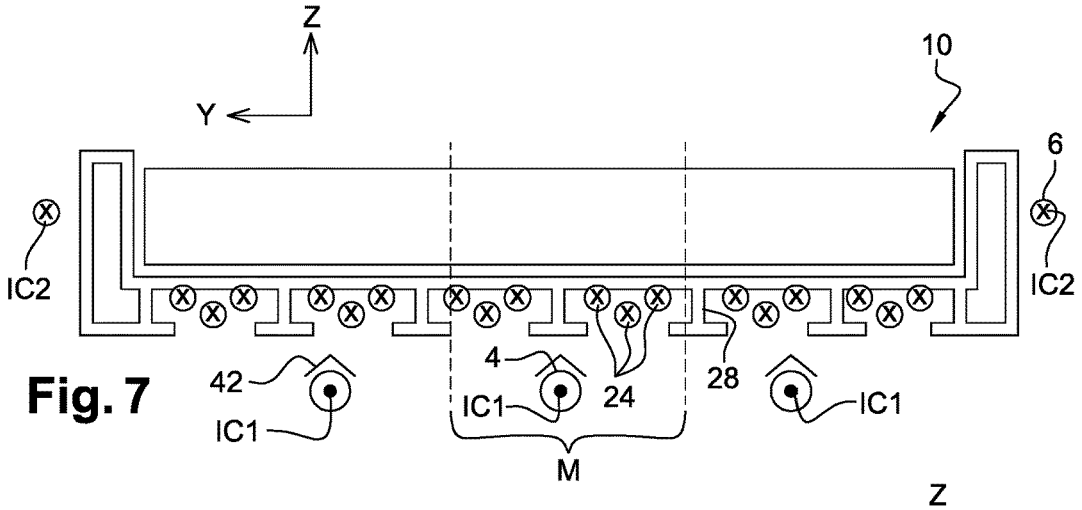
Fig. 7
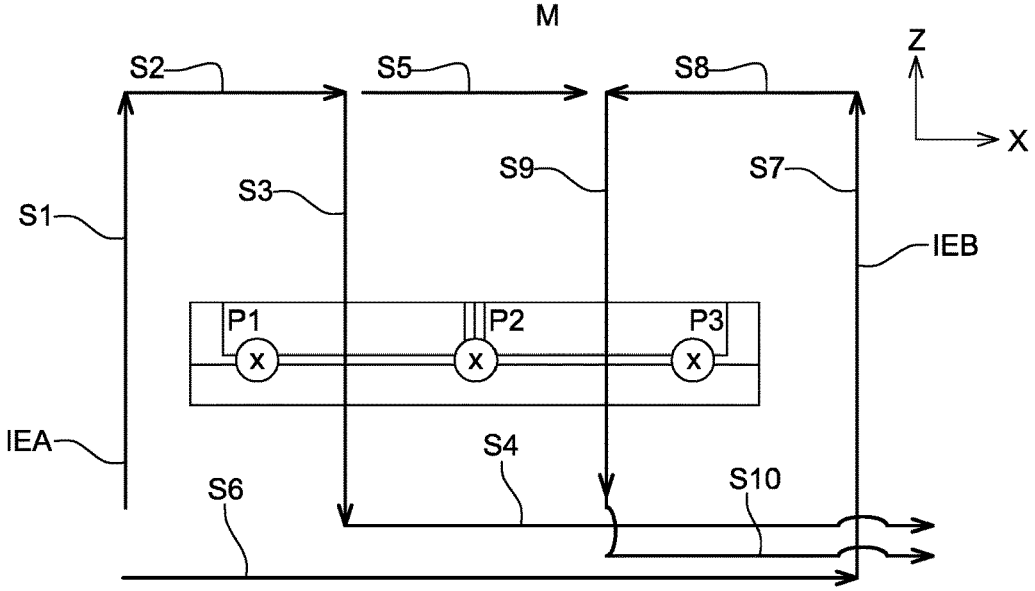
Fig. 8
Fig. 9
| Segment | Current |
|---|---|
| S1 | i + ia |
| S2 | i + ia |
| S3 | i |
| S4 | i |
| S5 | ia |
| S6 | ib |
| S7 | ib |
| S8 | ib |
| S9 | i |
| S10 | i |

| Parts | Zone N°1 | Zone N°2 | Zone N°3 |
|---|---|---|---|
| S1 | 0 | 0 | 0 |
| S2 | i + ia | ≈ 0 | ≈ 0 |
| S3 | 0 | 0 | 0 |
| S4 | ≈ 0 | + i | + i |
| S5 | ≈ 0 | + ia | ≈ 0 |
| S6 | + ib | + ib | + ib |
| S7 | 0 | 0 | 0 |
| S8 | ≈ 0 | ≈ 0 | - ib |
| S9 | 0 | 0 | 0 |
| S10 | ≈ 0 | ≈ 0 | + i |
| Total cell | i + ia + ib = 2i | i + ia + ib = 2i | 2i = 2i |
| 1st compensating circuit | -2ib | -2ib | -2ib |
| 2sd compensating circuit | - ( i + ia - ib ) | - ( i + ia - ib ) | - ( i + ia - ib ) |
| Total | 0 | 0 | 0 |

Fig. 13

| Parts | Zone N°1 | Zone N°2 | Zone N°3 |
|---|---|---|---|
| S1 | i + ia | ≈ 0 | - i - ia |
| S2 | i + ia | ≈ 0 | ≈ 0 |
| S3 | i | - i | ≈ 0 |
| S4 | ≈ 0 | - i | - i |
| S5 | ≈ 0 | + ia | ≈ 0 |
| S6 | - ib | - ib | - ib |
| S7 | +ib | ≈ 0 | - ib |
| S8 | ≈ 0 | ≈ 0 | - ib |
| S9 | ≈ 0 | + i | - i |
| S10 | ≈ 0 | ≈ 0 | - i |
| Total cell | 3i + 2ia | -i + ia - ib | -4i - ia - 3ib |
| 1st compensating circuit | +2ib | +2ib | +2ib |
| 2sd compensating circuit | 0 (without impact on By) | 0 (without impact on By) | 0 (without impact on By) |
| Total | 5i | 0 | -5i |

Fig. 14

ALUMINUM SMELTER AND METHOD TO COMPENSATE FOR A MAGNETIC FIELD CREATED BY THE CIRCULATION OF THE ELECTROLYSIS CURRENT OF SAID ALUMINUM SMELTER

CROSS-REFERENCE TO RELATED APPLICATIONS

This application is a U.S. National Stage application under 35 U.S.C. § 371 of International Application PCT/IB2016/000120 (published as WO 2016/128824 A1), filed Feb. 5, 2016, which claims priority to French Patent Application No. 1500251, filed Feb. 9, 2015, and the present application claims priority to and the benefit of both of these prior applications, each of which is incorporated by reference in its entirety.

The present invention relates to an aluminum smelter, for the production of aluminum by electrolysis, and a method for compensating for the vertical and horizontal components of a magnetic field generated by the flow of an electrolysis current in this aluminum smelter.

It is known that aluminum can be produced industrially from alumina by electrolysis using the Hall-Héroult process. For this purpose, an electrolytic cell is used comprising a steel pot shell within which there is a lining of refractory materials, a cathode of carbon material, through which pass cathode conductors intended to collect the electrolysis current at the cathode to route it to the cathode outputs which pass through the bottom or sides of the pot shell, linking conductors extending substantially horizontally to the next cell from the cathode outputs, an electrolyte bath in which the alumina is dissolved, at least one anode assembly comprising at least one anode immersed in this electrolyte bath, an anode frame on which the anode assembly is suspended, and conductors for raising the electrolysis current running upwards connected to linking conductors from the preceding electrolytic cell to route the electrolysis current from the cathode outputs to the anode frame and the anode assembly and anode in the next cell. The anodes are more particularly of the pre-baked anode type with pre-baked carbon blocks, i.e. baked before they are placed in the electrolytic cell.

An aluminum production plant, or an aluminum smelter, conventionally comprises several hundred electrolytic cells aligned transversely in parallel rows and connected in series.

An electrolysis current of the order of several hundred thousand Amperes passes through these electrolytic cells, and this creates a large magnetic field. The vertical component of this magnetic field, which is mainly produced by the linking conductors delivering current from one electrolytic cell to the next, is known to cause instabilities known as magnetohydrodynamic (MHD) instabilities.

These MHD instabilities are known to reduce the performance of the process. The more unstable the cell, the greater the interpolar distance between the anode and the layer of metal. Now, the greater the interpolar distance, the greater the energy consumption of the process because it is dissipated in the interpolar space by the Joule effect.

In addition to this, the horizontal components of the magnetic field, which is generated by all the flow of electric current in both the conductors within the cells and those outside, interact with the electric current passing through the liquids, giving rise to stationary deformation of the metal layer. The irregularities produced in the metal layer level need to be sufficiently small for the anodes to be consumed uniformly with little wastage. In order to ensure that changes in level are small, the horizontal components of the magnetic field have to be as antisymmetric as possible in the liquids (the electrolyte bath and the layer of metal). In the case of the longitudinal and transverse components of the magnetic field comprising the horizontal components, antisymmetry is taken to mean that at a distance perpendicular from the central axis of the cell parallel to the component of the field in question, and at the same distance on either side of this central axis, the value of the component in question will be the opposite. The antisymmetry of the horizontal components of the magnetic field is the configuration bringing about the most symmetrical and the flattest possible deformation of the interface in the cell.

It is known, in particular from patent documents FR1079131 and FR2469475, that MHD instabilities can be controlled by compensating for the magnetic field created by passage of the electrolysis current using a particular arrangement of the conductors carrying the electrolysis current. For example, according to patent document FR2469475, the linking conductors pass laterally around the ends or heads of each electrolytic cell. This is known as self-compensation. This principle is based on local balancing out of the magnetic field on the scale of one electrolytic cell.

The main advantage of self-compensation lies in the use of the electrolysis current itself to compensate for MHD instabilities.

Nevertheless, self-compensation can give rise to a major space requirement at the sides because the electrical conductors pass around the heads of the electrolytic cells.

Above all the great length of the linking conductors implementing this solution gives rise to an in-line electrical loss through the resistance effect of the conductors, and therefore increased operating costs, and requires a great deal of raw material, and therefore high manufacturing costs. These disadvantages are even more marked where the electrolytic cells are of large size and operate at high current intensity.

Also the design of an aluminum smelter having a self-compensated electrical circuit is fixed. Over the course of its service life it may become necessary to increase the intensity of the electrolysis current beyond the intensity envisaged at the time of design. This will also in fact change the distribution of the magnetic field from the self-compensated electrical circuit, which has not been designed for this new distribution, as a result of which it will no longer optimally compensate for this magnetic field. There are solutions for overcoming this lack of development potential and recovering magnetic compensation which is close to optimum, but these solutions are particularly complex and costly to implement.

Another solution for reducing MHD instabilities, known in particular from patent document FR2425482, involves using a secondary electrical circuit or outer loop along the sides of the rows of electrolytic cells. A current whose intensity is equal to a predetermined percentage of the intensity of the electrolysis current passes through this secondary electrical circuit. The outer loop generates a magnetic field which compensates for the effects of the magnetic field created by the electrolysis current in the nearby row of electrolytic cells.

It is also known from patent document EP0204647 that a secondary circuit running along the sides of the rows of the electrolytic cells can be used to reduce the effect of the magnetic field created by the linking conductors, the intensity of the current passing through the electrical conductors in this secondary circuit being of the order of 5 to 80% of the intensity of the electrolysis current, the current flowing in the same direction as the electrolysis current.

The solution of providing compensation through an outer loop has the advantage that it provides a secondary circuit independent of the main circuit through which the electrolysis current passes.

Positioning the secondary circuit along the sides of the rows of cells close to the smaller sides of the pot shells at the level of the bath-metal interface makes it possible to compensate for the vertical component without having any impact on the horizontal components of the magnetic field.

The solution of providing compensation through an outer loop significantly reduces the length of the linking conductors, their mass and electrical losses, but requires an additional electricity power station and an additional independent secondary electrical circuit.

It will also be noted that the solution of providing compensation through an outer loop implies an accumulation of magnetic fields, together with the series current, creating a very strong overall ambient field, to the extent that this gives rise to constraints on operations and equipment (for example, the shielding required for vehicles) and to the extent that the magnetic field from one row has an effect on the stability of the cells in the adjacent row. In order to reduce the influence of one row on the adjacent row, they must be separated from each other, and this is a major spatial constraint which consequently implies that each row of electrolytic cells must be housed within a separate hall.

In addition to this, the connecting portion between the electrolysis circuit and the secondary circuit connecting the ends of two adjacent rows of electrolytic cells tends to destabilize the cells at the end of a row. In order to avoid having unstable cells at the end of a row, this portion of the secondary circuit can be configured on the basis of a predetermined path, as is known from patent FR2868436, in order to correct the magnetic field so that its impact on the cells at the end of a row becomes acceptable. However this route appreciably increases the length of the secondary circuit, and therefore the material cost. It should be noted that the usual solution involves moving the junction portion between the secondary circuit and the electrolysis circuit of the cells located at the end of a row further away, but this increases the use of space as well as increasing the length of the electrical conductors, and therefore material and energy costs.

It is therefore apparent that known solutions for providing compensation through an outer loop give rise to relatively major structural costs.

This invention, then, is intended to overcome these advantages either wholly or in part by providing an aluminum smelter with a magnetic configuration making it possible to have cells that are very stable magnetically, and giving improved compactness. This invention also relates to a method for compensating for the magnetic field created by the flow of the electrolysis current in the aluminum smelter To this end, the present invention relates to an aluminum smelter comprising at least one row of electrolytic cells arranged transversely in relation to the length of said at least one row, one of the electrolytic cells comprising anode assemblies and rising and connecting electrical conductors to the anode assemblies, characterized in that the rising and connecting electrical conductors extend upwardly along two opposite longitudinal edges of the electrolytic cell for conducting electrolysis current to the anode assemblies, and in that the aluminum smelter includes at least one first electrical compensation circuit extending beneath the electrolytic cells, said at least one first electrical compensation circuit being possibly traversed by a first compensation current designed to flow under the electrolytic cells in the opposite direction to the global direction of flow of the electrolysis current, at least one second electric compensation circuit extending over at least one side of said at least one row of electrolytic cells, said at least one second electric compensation circuit being possibly traversed by a second compensation current designed to flow in the same direction as the global direction of flow of the electrolysis current.

In this way, the aluminum smelter according to the invention offers the advantage of providing highly magnetically stable cells, since they compensate for both the horizontal and vertical components of the magnetic field generated by the flow of the electrolysis current, which improves overall performance, without negative impact on the size of the aluminum smelter of the invention, since the first compensating electrical circuit extends under the electrolytic cells.

According to a preferred embodiment, the rising and connecting electrical conductors comprise upstream rising and connecting electrical conductors, adjacent to the upstream longitudinal edge of the electrolytic cell, and downstream rising and connecting electrical conductors, adjacent to the downstream longitudinal edge of the electrolytic cell, and the aluminum smelter is laid out so that the distribution of the electrolysis current is asymmetrical between the upstream and downstream rising and connecting electrical conductors, the intensity of the upstream electrolysis current designed to run through all of the rising and connecting electrical conductors upstream of the electrolytic cell being equal to] 50-100 [% of the intensity of the electrolysis current, and the intensity of the downstream electrolysis current designed to run through all of the rising and connecting electrical conductors downstream of the electrolytic cell is equal to] 0-50[% of the intensity of the electrolysis current, the total intensity of the upstream and downstream electrolysis currents being equal to the intensity of the electrolysis current.

One advantage of these characteristics is to enable efficient compensation for the magnetic field for an electrolytic cell of large dimensions, in particular of large width, at no extra cost in raw materials.

If the distribution of the upstream-downstream electrolysis current is symmetrical, i.e. if this distribution is 50% upstream and 50% downstream, and the width of the electrolytic cells is increased, for improved performance, an imbalance detrimental to the proper functioning of the electrolytic cell is created, due to the increase in the distance covered by the routing electrical conductors under the electrolytic cell to supply the downstream rising and connecting electrical conductors. To restore balance, it would be necessary to increase the section of said routing electrical conductors under the electrolytic cell. But this increase in section involves a significant additional cost for raw materials. However, the applicant observed that the aluminum smelter of the present invention allows an asymmetry in the distribution of the electrolysis current between the upstream and the downstream of the electrolytic cells to be introduced without any detrimental increase in the section of the routing electrical conductors, while providing very magnetically stable electrolytic cells.

The choice of distribution between upstream and downstream electrolysis current intensities is made by means of an economic study. This choice depends mainly on the distance between two cells and the height of the cells. This distribution is carried out by adjusting the sections of the electrical conductors of the upstream and downstream electrical circuits, taking into account their length.

According to a preferred embodiment, the aluminum smelter comprises a power station configured to cause to flow through said at least one first compensating electrical circuit a first compensating current of intensity equal to twice the intensity of the downstream electrolysis current to the nearest 20% above or below, and preferably to the nearest 10% above or below.

One advantage of this feature is that for this intensity of the first compensation current, which is directly related to the distribution of the electrolytic current between the upstream and the downstream of the electrolytic cells, the applicant observed that the horizontal magnetic field generated by the first compensating electrical circuit accurately corrects the asymmetry of the horizontal magnetic field resulting from the asymmetry between the upstream and downstream electrolysis current, in order to have an antisymmetric distribution of the horizontal components of the magnetic field. This first compensating current also partially corrects the vertical magnetic field, depending on the distribution between upstream and downstream electrolysis current of the cell, to reduce the MHD instabilities in the cell.

According to a preferred embodiment, the aluminum smelter includes a power station configured to cause to flow through said at least one second electrical compensating circuit a second compensating current of intensity between 50% and 100% of the difference in intensity between the upstream and downstream electrolysis currents, and preferably between 80% and 100% of the difference in intensity between the upstream and downstream electrolysis currents.

Intensity of the second compensation current is defined as the total current flowing in the conductors forming the second compensating circuit, particularly when the second compensating circuit comprises two conductors (or loops) arranged on either side of the electrolytic cell.

The applicant observed that for this of intensity of the second compensating current, which is also directly related to the distribution of the electrolytic current between the upstream and the downstream of the electrolytic cells, the vertical magnetic field generated by the second electric compensating circuit corrects the vertical magnetic field generated by the electrolysis current flowing in the main electrical circuit (cell to cell circuit) already partially corrected by the current flowing in the first compensating circuit.

Note that this feature is particularly advantageous when used in combination with the previous one.

According to a preferred embodiment, the rising and connecting electrical conductors are distributed at regular intervals along the longitudinal edge of the electrolytic cell to which these rising and connecting electrical conductors are adjacent.

One advantage of this feature is to have a uniform distribution over the entire length of the cell of the horizontal longitudinal component of the magnetic field (i.e. parallel to the length of the electrolytic cell), making it possible to facilitate compensating via the first compensating circuit.

The rising and connecting electrical conductors are advantageously arranged symmetrically relative to the transverse median plane XZ of the electrolytic cells, which makes it possible to obtain an antisymmetric distribution of the transverse component of the magnetic field along X.

According to a preferred embodiment, the upstream rising and connecting electrical conductors and the downstream rising and connecting electrical conductors are equidistant from a longitudinal central plane YZ of the electrolytic cell.

According to a preferred embodiment, the upstream rising and connecting electrical conductors and the downstream rising and connecting electrical conductors are arranged substantially symmetrically relative to said longitudinal median plane YZ of the electrolytic cell.

This configuration, combined with the first compensating circuit, ensures perfect antisymmetry of the longitudinal component of the magnetic field along Y.

According to a preferred embodiment, said at least one first electrical compensating circuit includes electrical conductors extending under the electrolytic cells together forming a layer made up of a plurality of parallel electrical conductors, typically from two to twelve, and preferably three to ten parallel electrical conductors.

The number of parallel conductors required depends in part on the distance between the liquids and these conductors. The greater the distance, the lower the number of conductors; the shorter the distance, the higher the number of conductors.

One advantage of this feature is that compensation is distributed under the whole length of the electrolytic cell, in this way giving better results. Note that the first electric compensating circuit is configured so that the first compensating current flows in the same direction through all the electrical conductors of the layer.

The intensity of the first compensating current corresponds to the sum of the currents flowing in each of the parallel electrical conductors of the layer extending under the cells.

According to a preferred embodiment, the electrical conductors of said layer are arranged at regular intervals from each other along a longitudinal direction Y of the electrolytic cells.

According to a preferred embodiment, the electrical conductors of said layer are arranged substantially symmetrically with respect to a transverse median plane XZ of the electrolytic cells.

According to a preferred embodiment, the electrical conductors of said layer are arranged in the same horizontal plane XY.

One advantage of these features is to further improve the compensation of the adverse magnetic field.

According to a preferred embodiment, said at least one second electric compensating circuit includes electrical conductors extending from each side of said at least one row of electrolytic cells, and the second compensating current flows in the same direction as the direction of the overall flow of the electrolysis current on each side of the electrolytic cells.

In this way, the electrical conductors of said at least one second electric compensating circuit form an inner loop and an outer loop, and in this way provide improved compensation of the magnetic field. Inner loop means the loop closest to the neighboring row and outer loop means the loop furthest away.

According to a preferred embodiment, the intensity of a second compensating current flowing in an inner loop of said at least one second compensating circuit differs from the intensity of a second compensating current flowing in an outer loop of said at least one second compensating circuit.

This feature compensates for the residual magnetic field vertical to the neighboring row.

The intensity of the second compensating current corresponds to the sum of the currents flowing in each of the loops.

According to a preferred embodiment, the intensity of the second compensating current in the inner loop is greater than the intensity of the second compensating current flowing in the outer loop.

This makes it possible to correct the magnetic field created by the neighboring row. This neighboring row creates a magnetic field proportional to a current in the series from which is subtracted twice the downstream electrolysis current, while a "conventional" electrolysis series will be subject to a magnetic field directly proportional to the total electrolysis current. In this way, with the first compensating circuit, the interference field created by the neighboring row is much weaker and requires much less correction. Therefore, concerning the second compensating circuit, the difference between the intensity of the inner loop and that of the outer loop will be much weaker than in the case of patent EP0204647 and the gap between the two cell rows can be minimized.

According to a preferred embodiment, the electrical conductors forming the second compensating electrical circuit are substantially symmetrical with respect to a median transverse plane XZ of the electrolytic cells.

This improves compensation of the adverse magnetic field.

According to a preferred embodiment, the electrical conductors of the second compensating electrical circuit extend in the same horizontal plane XY, preferably at the height of a layer of liquid aluminum formed inside the electrolytic cells during the electrolysis reaction.

This arrangement improves compensation of the vertical magnetic field without affecting the horizontal component of the field already compensated for by the first compensating circuit.

Preferably, the aluminum smelter consists of two consecutive parallel rows of electrolytic cells, and the circuit of the inner loop forms, at the end of the row, means of compensating for "end-of-row" effects caused by the connecting conductors between the rows, which provides greater magnetic stability and therefore improves the performance of the end-of-row cells.

According to a preferred embodiment, said at least one first electric compensating circuit is independent of the main electrical circuit through which the electrolysis current flows.

This feature has the advantage of limiting the consequences of any damage such as the electrolytic cell being perforated by the fluids contained in the electrolytic cell. In addition, this feature is advantageous in terms of scalability, since it makes it possible to vary the intensity of the first compensating current to adjust the magnetic compensation. Adjustment of magnetic compensation is useful when the electrolytic cells are modified, because the magnetic configuration of these electrolytic cells is modified, or to adapt the stirring of the alumina to the quality of this alumina (which makes it possible to maintain optimum performance despite the different quality of the alumina).

According to a preferred embodiment, said at least one second electric compensating circuit is independent of the main electrical circuit through which the electrolysis current flows.

As explained above, this gives an advantage in terms of scalability since it makes it possible to vary the intensity of the first compensating current to adjust the magnetic compensation.

According to a preferred embodiment, the electrolytic cell is of modular electrical construction in N modules repeated in the direction of its length, each module comprising electrical conductors configured to generate the same predetermined magnetic configuration.

This feature is advantageous in terms of scalability: it allows modifications to the electrolytic cell, for example making it bigger by adding one or more modules without changing the principle of magnetic balancing of the electrolytic cell.

To obtain the same magnetic configuration, each electrical module has the same arrangement of electrical conductors, each electrical conductor of an electrical module having the same intensity flowing through it and the same direction of current flow as the corresponding electrical conductor of an adjacent electrical module. The electrical conductors of each module include the rising and connecting electrical conductors, the anode assemblies, the cathodes, the cathode conductors, the cathodic outputs, the routing electrical conductors, and electrical conductors of the layer of electrical conductors of the first electrical compensating circuit. These electrical conductors are arranged each in relation to the other in the same way from one module to another. In particular, each electrical module includes the same number of electrical conductors of the layer of electrical conductors of the first electric compensating circuit.

It is specified that the electrolytic cells of the aluminum smelter include any or all of the above characteristics of the electrolytic cell.

The invention also relates to a method of compensating for a magnetic field created by the flow of an electrolysis current in a plurality of electrolytic cells of an aluminum smelter having the above characteristics, the method comprising:

flow, in the opposite direction to the direction of overall flow of the electrolysis current, of a first compensating current through said at least one first electrical compensating circuit, flow, in the same direction as the direction of overall flow of the electrolysis current, of a second compensating current through said at least one second electrical compensating circuit.

In this way, this method offers effective magnetic compensation of the magnetic field generated by the circulation of the electrolysis current in the series of electrolytic cells of the aluminum smelter, thereby limiting spatial requirements.

According to a preferred embodiment, the method comprises an asymmetric distribution of the electrolytic current between the upstream and the downstream of the electrolytic cells, the set of rising and connecting electrical conductors upstream of the electrolytic cells being traversed by an upstream electrolysis current of intensity between]50-100[% of the intensity of the electrolysis current, and the set of rising and connecting electrical conductors downstream of the electrolytic cells being traversed by a downstream electrolysis current of intensity between]0-50[% of the intensity of the electrolysis current, the sum of intensities of the upstream and downstream electrolysis currents being equal to the intensity of the electrolysis current.

This method makes it possible to obtain magnetically stable electrolytic cells, even when the electrolytic cells are of large dimensions, in particular of great width. Performance can in this way be significantly increased.

According to a preferred embodiment, the intensity of the first compensating current is equal to twice the intensity of the downstream electrolysis current, to the nearest 20%, and preferably to the nearest 10%.

One advantage of this feature is that for this value of the intensity of the first compensating current, which is directly related to the distribution of the electrolytic current between the upstream and the downstream of the electrolytic cells, the applicant observed that the horizontal magnetic field generated by the first electric compensating circuit precisely corrects the asymmetry between the upstream and downstream current, in order to have an antisymmetric distribution of the components of the horizontal magnetic field. This first compensating current also corrects all or part of the vertical magnetic field according to the distribution between the electrolysis current upstream and downstream of the cell, in order to reduce the MHD instabilities in the cell. The entire vertical magnetic field is corrected if the distribution between upstream and downstream is 50%.

According to a preferred embodiment, the intensity of the second compensating current is between 50% and 100% of the difference in intensity between the upstream and downstream electrolysis currents, and preferably between 80% and 100% of the difference in intensity between the upstream and downstream electrolysis currents.

Similarly, the applicant observed that for the intensity value of the second compensating current, which is also directly related to the distribution of the electrolysis current between upstream and downstream of the electrolytic cells, the vertical magnetic field generated by the second electric compensating circuit precisely corrects the remaining vertical magnetic field resulting from the sum of the vertical magnetic field of the electrolysis current (cell-to-cell circuit) and the first compensating circuit According to a preferred embodiment, said at least one second electric compensating circuit comprises an inner loop and an outer loop, and wherein the intensity of a second compensating current flowing in the inner loop is different from the intensity of a second compensating current flowing in the outer loop.

According to a preferred embodiment, the intensity of the second compensating current flowing in the inner loop is greater than the intensity of the second compensating current flowing in the outer loop.

According to a preferred embodiment, the method comprises a step of analyzing at least one characteristic of the alumina in at least one of the electrolytic cells of said aluminum smelter, and determining the intensity values of the first compensating current and the second compensating current to be made to flow as a function of said at least one characteristic analyzed.

In this way, the method can be used to modify the magnetic compensation, in order to deliberately induce, in special cases, a modification of the flow in the liquids and flow rates while controlling (slightly degrading) the MHD instability of the bath/metal interface. The flow of liquids (bath+aluminum) contributes to stirring the alumina, which, depending on the speed and the shape of the flow and depending on the quality of the alumina, improves performance. This preferred embodiment in this way improves performance by optimizing the flow to dissolve the alumina while controlling the level of "degradation" of the MHD stability of the bath/metal interface.

Figure 2:
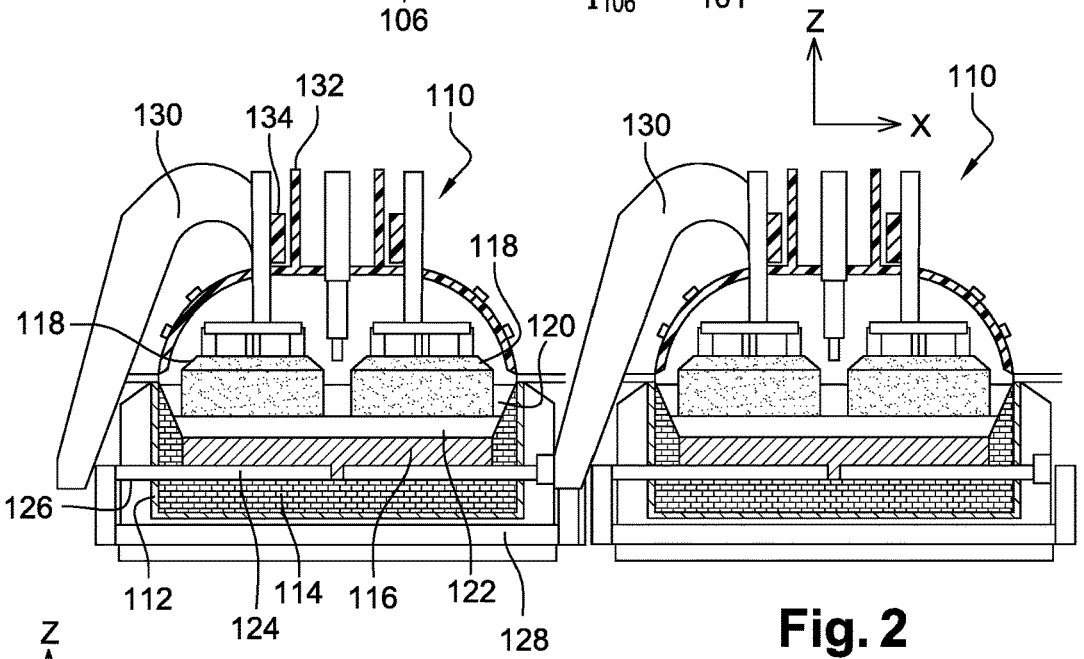
Figure 3:
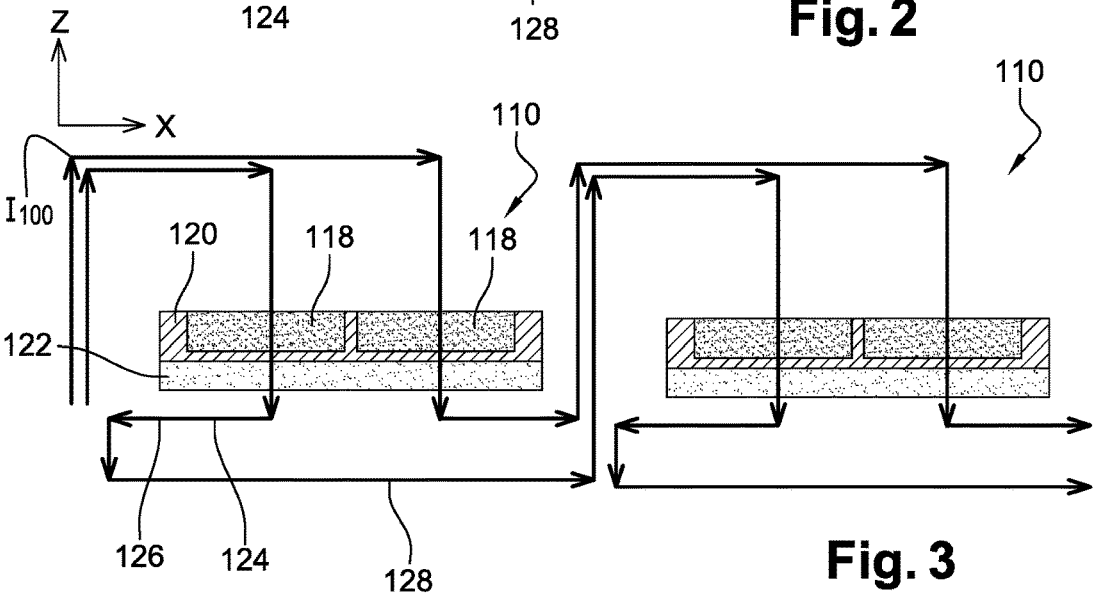
Figure 4:
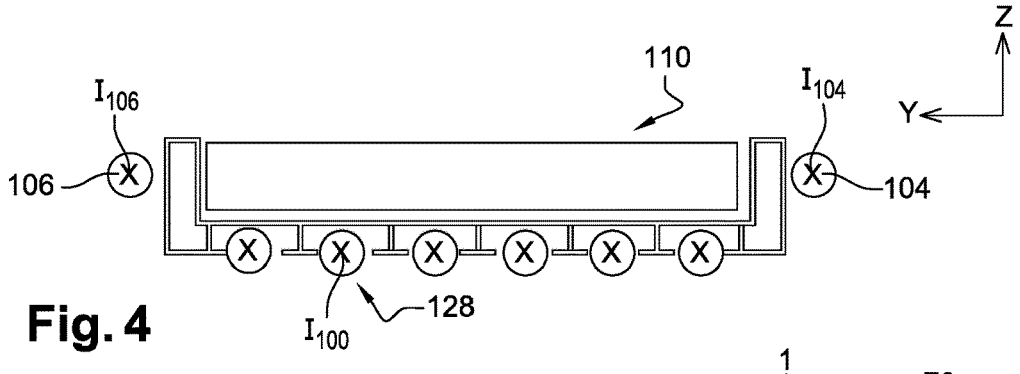
Figure 5:
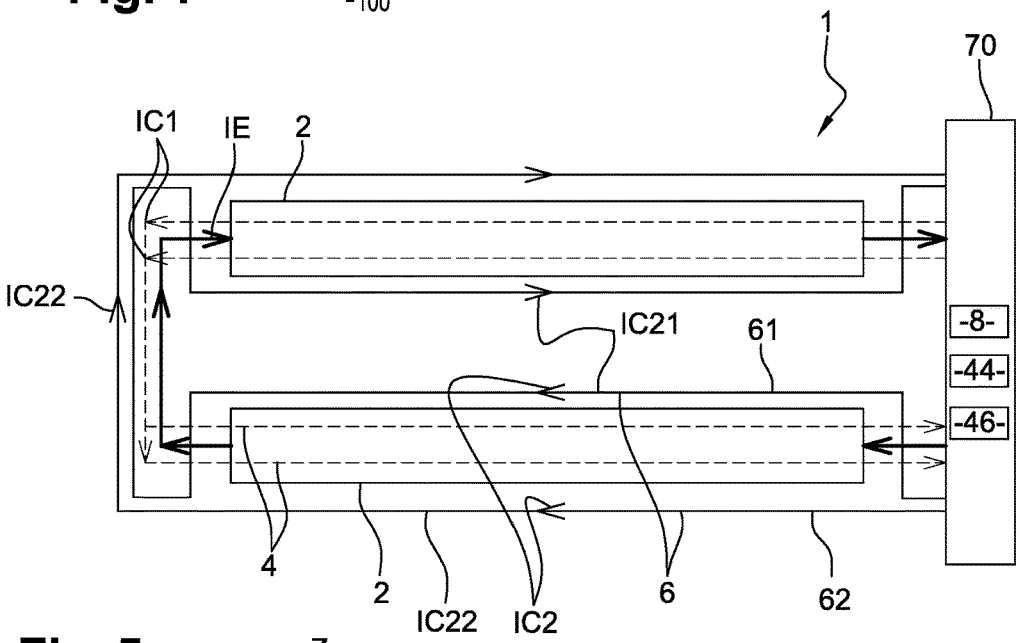
Figure 6:
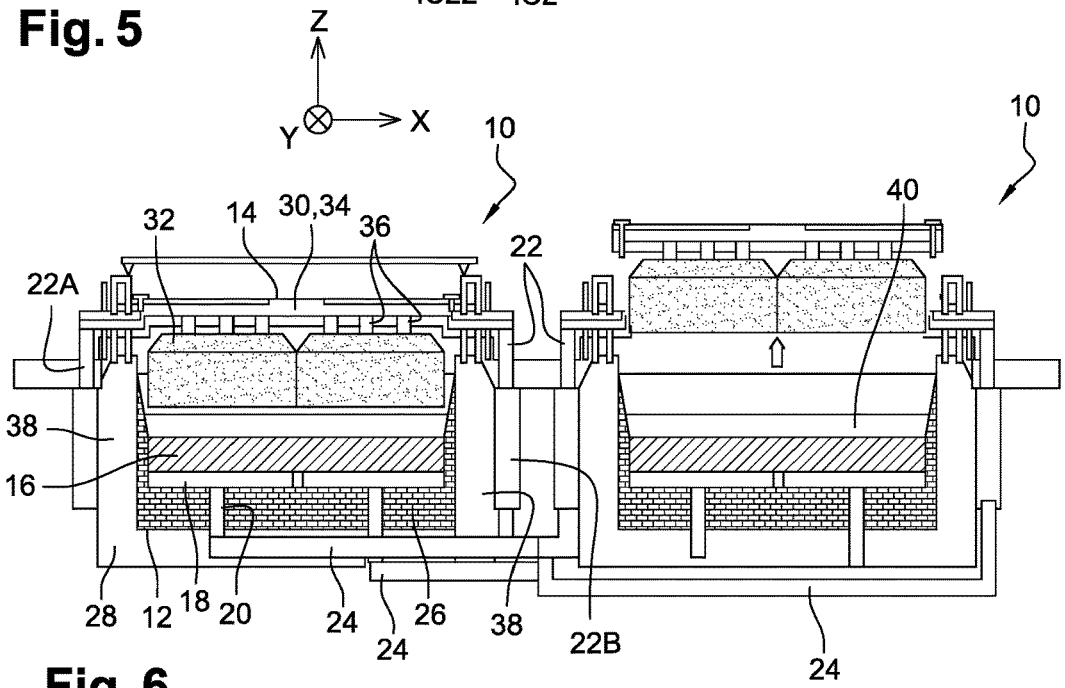
Figure 10:
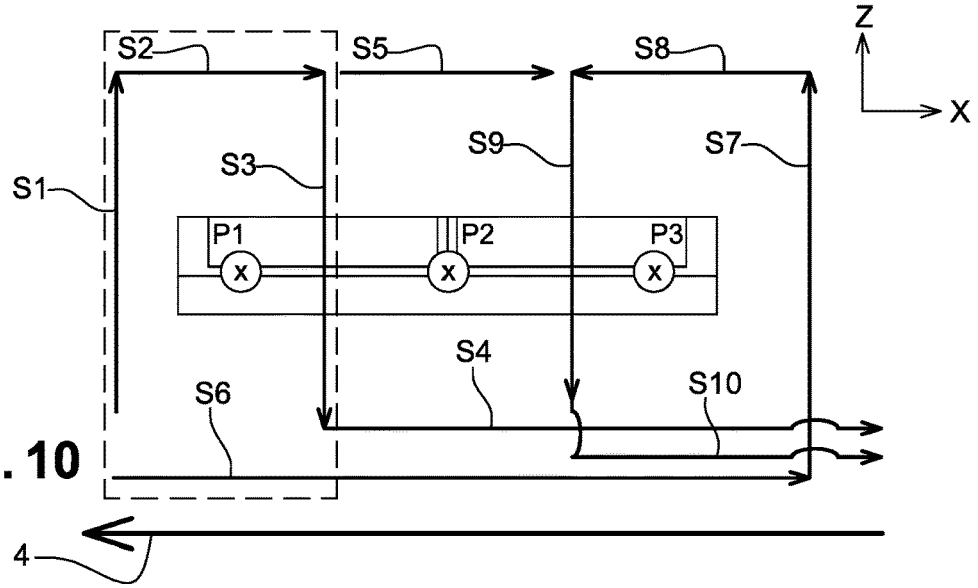
Figure 11:
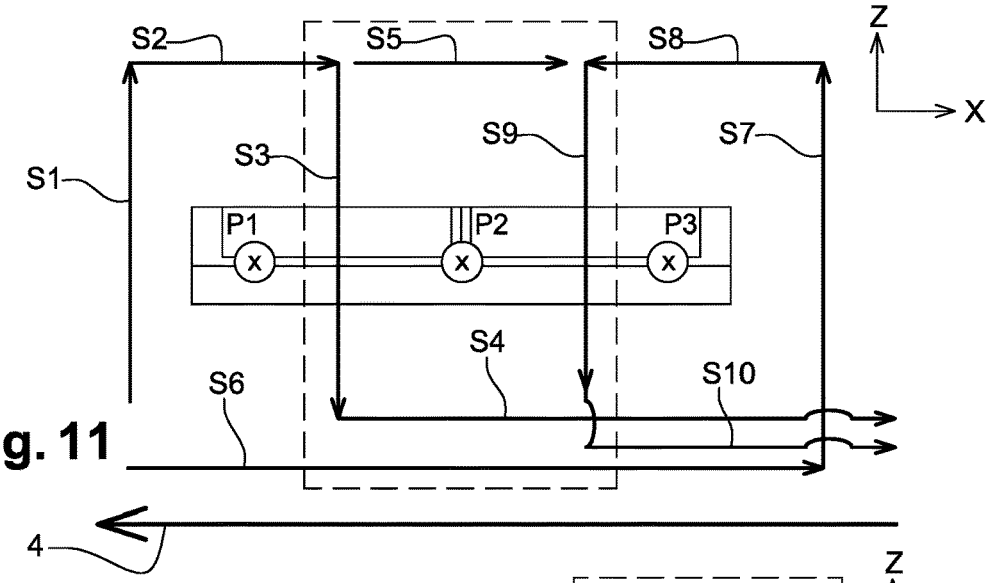
Figure 12:
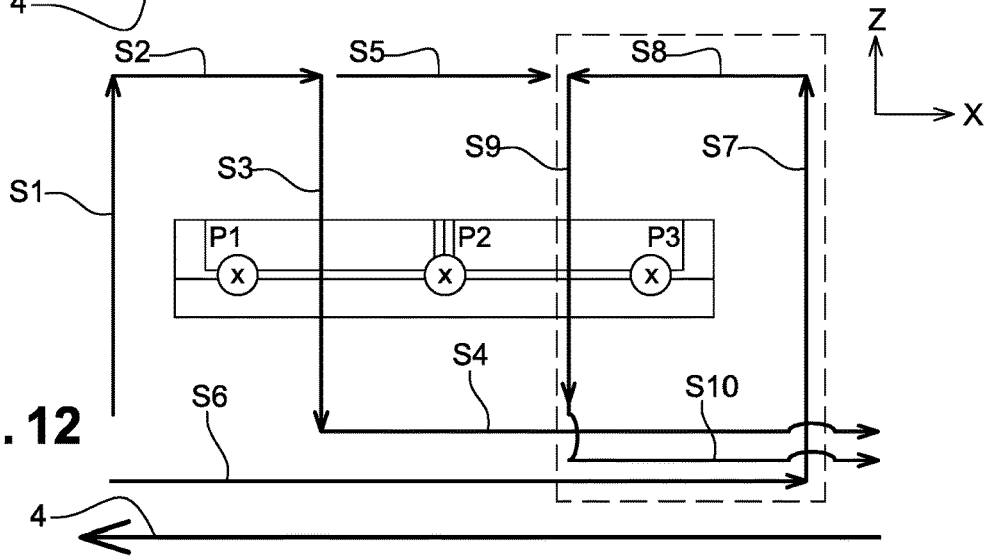

Other characteristics and advantages of this invention will be clearly apparent from the following description of a particular embodiment provided by way of a non-limiting example with reference to the appended drawings, in which:

FIG. 1 is a schematic view of an aluminum smelter according to the state of the art, FIG. 2 is a schematic view from the side of two successive electrolytic cells according to the state of the art, FIG. 3 is a line diagram of the electrical circuit through which the electrolysis current flows in the two electrolytic cells in FIG. 2, FIG. 4 is a schematic view in cross-section along a longitudinal vertical plane of an electrolytic cell according to the state of the art, FIG. 5 is a schematic view of an aluminum smelter according to one embodiment of the invention, FIG. 6 is a schematic view from the side of two successive electrolytic cells in an aluminum smelter according to one embodiment of the invention, FIG. 7 is a schematic view from the side of two successive electrolytic cells in an aluminum smelter according to one embodiment of the invention, FIG. 8 is a schematic view from the side of two successive electrolytic cells in an aluminum smelter according to one embodiment of the invention, FIG. 9 is a table showing the intensity of the electrolysis current through each segment of FIG. 8, FIGS. 10 to 12 are schematic wiring diagrams of the electric circuit through which the electrolysis current flows in an electrolytic cell of an aluminum smelter according to one embodiment of the invention, showing for this electrolytic cell zones generating a significant magnetic field, FIG. 13 is a table showing the contribution of each segment in FIGS. 10 to 12 in computing the vertical component of the magnetic field generated by the flow of the electrolysis current, FIG. 14 is a table showing the contribution of each segment in FIGS. 10 to 12 in computing the longitudinal horizontal component of the magnetic field generated by the flow of the electrolysis current, FIG. 1 shows an aluminum smelter 100 according to prior art. Aluminum smelter 100 comprises electrolytic cells arranged transversely in relation to the length of the row which they form. The electrolytic cells are here aligned in two parallel rows 101, 102. These electrolytic cells are traversed by an electrolysis current $I_{100}$. Two compensating electrical circuits 104, 106, run along the sides of rows 101, 102 to compensate for the magnetic field generated by the flow of electrolysis current $I_{100}$ from one electrolytic cell to another and in the adjacent row. Electrical compensating circuits 104, 106 respectively are traversed by currents $I_{104}$, $I_{106}$ flowing in the same direction as electrolysis current $I_{100}$. Power stations 108 provide power to the series of electrolytic cells and compensating electrical circuits 104, 106. According to this example, for an electrolysis current of intensity 500 kA, and taking into account "end-of-row" magnetic disturbances, the distance $D_{100}$ between the electrolytic cells closest to power stations 108 and power stations 108 is of the order of 45 m, and the distance $D_{300}$ over which compensating electrical circuits 104, 106 extend beyond the ends of the row, is of the order of 45 m, while the distance $D_{200}$ between the two rows 101, 102 is of the order of 85 m in order to limit magnetic disturbances between one row and another.

FIG. 2 shows two consecutive conventional electrolytic cells 110 in one row of electrolytic cells. As shown in FIG. 2, electrolytic cell 110 comprises a pot shell 112 lined internally with refractory materials 114, a cathode 116 and anodes 118 immersed in an electrolyte bath 120, at the bottom of which a layer 122 of aluminum forms. Cathode 116 is electrically connected to cathode conductors 124 which pass through the sides of pot shell 112 at the level of cathode outputs 126. Cathode outputs 126 are connected to linking conductors 128 which route the electrolysis current to the rising and connecting conductors 130 of the next electrolytic cell. As shown in FIG. 2, these rising and connecting conductors 130 extend obliquely along a single side, the upstream side, of electrolytic cells 110 and extend above anodes 118 as far as the central longitudinal part of electrolytic cells 110.

The electrolytic cell comprises a superstructure 132 extending there through longitudinally above pot shell 112 and anodes 118. The superstructure 132 in particular includes a beam resting on feet (not shown) at each of its longitudinal ends. The beam supports an anode frame 134, this anode frame 134 also extending longitudinally above pot shell 112 and anodes 118. The anode frame 134 supports the anode assemblies, the latter being electrically connected to the anode frame 134.

FIG. 3 schematically illustrates the path traveled by electrolysis current $I_{100}$ in each of electrolytic cells 110 and between two adjacent electrolytic cells 110, such as those shown in FIG. 2. It will in particular be noted that the electrolysis current $I_{100}$ rises up to the anode assembly of an electrolytic cell 110 asymmetrically because this rise takes place only upstream of the electrolytic cells 110 in the overall direction of flow of electrolysis current $I_{100}$ within the row (to the left of the cells in FIGS. 2 and 3).

FIG. 4 shows the arrangement on the sides of cells 110 of state-of-the-art electrical conductors forming electrical compensation circuits 104, 106, these electrical conductors being traversed respectively by compensation currents $I_{104}$, $I_{106}$ flowing in the same direction as the electrolysis current $I_{100}$ flowing here through routing conductors 128 positioned below the cell.

FIG. 5 shows an aluminum smelter 1 according to one embodiment of the invention. Aluminum smelter 1 is designed for aluminum production using electrolysis by means of the Hall-Héroult process.

Aluminum smelter 1 comprises a plurality of electrolytic cells, which are substantially rectangular, designed to produce aluminum by electrolysis. These electrolytic cells can be aligned in one or more rows 2, which may be substantially parallel. Where appropriate, rows 2 are electrically connected in series and supplied with electrolysis current IE. Aluminum smelter 1 also comprises a first electrical compensating circuit 4 which extends under the row or rows of electrolytic cells, and a second electric compensating circuit 6, which extends over at least one side of the row or rows 2 of electrolytic cells. According to the example shown in FIG. 5, the second electrical compensating circuit 6 extends on both sides of each row 2 of electrolytic cells. Still according to the example shown in FIG. 5, the aluminum smelter comprises two rows of cells arranged in parallel relative to one another, fed by a single power station 8, and electrically connected in series so that the electrolysis current IE flowing in the first two rows 2 of electrolytic cells then flows into the second of the two rows 2 of electrolytic cells. The electrolytic cells are arranged transversely in relation to each row 2 that these electrolytic cells form. It will be noted that by a transversely arranged electrolytic cell 2, is meant an electrolytic cell 2 whose largest dimension, its length, is substantially perpendicular to the overall direction in which electrolysis current IE flows.

In the present description, upstream and downstream are defined with respect to the overall direction of flow of the electrolysis current IE, i.e. the direction of flow of IE electrolysis current at the level of the row 2 of electrolytic cells.

It is also pointed out that the description is provided in relation to a Cartesian frame of reference relating to an electrolytic cell, the X axis being orientated in a transverse direction of the electrolytic cell, the Y axis being orientated in a longitudinal direction of the electrolytic cell and the Z axis being orientated in a vertical direction of the electrolytic cell. Longitudinal, vertical and transverse orientations, directions, plans and movements are defined relative to this standard.

Note that the electrolytic cells in the aluminum smelter are preferably electrolytic cells of large dimensions, the use of large electrolytic cells being made possible by the particular layout of the electrolytic cells in the aluminum smelter according to the invention, as described in more detail below. The dimensions of an electrolytic cell are defined by the floor area that the electrolytic cell represents. For this, it is considered that the dimensions of the cell are defined by the outer dimensions of its pot shell. A large electrolytic cell means an electrolytic cell having a width greater than 4 m, preferably greater than or equal to 5 m, and especially greater than or equal to 6 m, and/or having a length greater than 15 m, preferably greater than or equal to 20 m, and especially greater than or equal to 25 m FIG. 6 shows in more detail electrolytic cells 10 in aluminum smelter 1 according to one embodiment. As illustrated in this figure, electrolytic cells 10 of aluminum smelter 1 comprise a pot shell 12, anode assemblies 14, a cathode 16 through which pass the cathode electrical conductors 18 designed to collect the electrolysis current IE at cathode 16 to route it to other electrical conductors called cathode outputs 20 outside the pot shell 12, rising electrical conductors 22 for connecting to the anode assemblies 14 to route the electrolysis current IE to anode assemblies 14 and electrical routing conductors 24 connected to cathodic outputs 20 designed to route the electrolysis current IE from the cathode outputs 20 to the rising and connecting electrical conductors 22 of the next electrolytic cell 10.

Pot shell 12 includes an inner lining 26 made of refractory materials. As illustrated in FIGS. 6 and 7, the pot shell 12 preferably includes reinforcement cradles 28. Pot shell 12 may be metallic, for example made of steel.

Anode assemblies 14 comprise a support 30 and at least one anode 32. The anode or anodes 32 are particularly made of carbonaceous material, and more particularly of the pre-baked type. Support 30 includes a first electrically conductive portion 34, such as a crossbeam extending substantially along a transverse direction X of the electrolytic cells 10, and a second electrically conductive portion 36 formed of a plurality of electrically conductive elements that may be called "stubs", the stubs having a distal end electrically connected to the first portion 34 of the support 30 and a proximal end electrically connected to the anode or anodes 32 to route the electrolysis current IE from the first portion 34 of the support 30 to this/these anode(s) 32. The anode assemblies 14 are designed to be removed and replaced periodically when the anode or anodes 32 are spent.

Cathode 16 may be formed from several cathode blocks made of carbonaceous material. Cathode 16 is traversed by the cathode conductors 18 designed to collect the electrolysis current IE at the cathode 16 to route it to the cathode outputs 20 preferably exiting from the bottom of pot shell 12, as shown in FIG. 6.

The rising and connecting electrical conductors 22 extend upwardly along two opposite longitudinal edges 38 of each electrolytic cell 10, to route the electrolysis current IE to the anode assemblies 14. It is specified that the longitudinal edges 38 of electrolytic cells 10 correspond to the edges with the largest dimension, i.e. the edges of the electrolytic cells 10 which are substantially parallel to the longitudinal direction Y. For example, an electrolytic cell 10 operating with a current intensity of 400 to 1,000 k Amperes may for example preferably comprise 4 to 40 rising and connecting conductors 22 regularly spaced over the entire length of each of its two longitudinal edges 38. The longitudinal rising and connecting electrical conductors 22 comprise upstream rising and connecting electrical conductors 22A, i.e. adjacent to the longitudinal edge 38 upstream of the electrolytic cell 10, and downstream rising and connecting electrical conductors 22B, i.e. adjacent to the longitudinal edge 38 downstream of the electrolytic cell 10. The upstream rising and connecting electrical conductors 22A are electrically connected to an upstream end of the first portion 34 of support 30, and the downstream rising and connecting electrical conductors 22B are electrically connected to a downstream end of this first portion 34 of support 30.

Routing electrical conductors 24 are connected to the cathode outputs 20 and are designed to route the electrolysis current IE from these cathode outputs 20 to the rising and connecting electrical conductors 22 of the next electrolytic cell 10 in the series.

The cathode conductors 18, the cathode outputs 20 and/or the routing conductors 24 may be metal bars, possibly composites, such as aluminum, copper and/or steel.

A layer of liquid aluminum 40 is formed during the electrolysis reaction.

Note that the electrolytic cells 10 of the aluminum smelter 1 according to the invention are preferably electrolytic cells 10 for which anode replacement is by vertical upward traction of the anode assemblies 14 above the electrolytic cell 10, as shown via the electrolytic cell 10 on the right in FIG. 6. The rising and connecting conductors 22 extend on either side of the cabinet 12 without extending in line with anodes 32, i.e. without extending within a volume obtained by vertical projection of the projected area of anodes 32 in a horizontal plane. Besides the advantage that this represents for allowing anode 32 to be changed by ascending vertical traction, it also reduces the length of the rising and connecting conductors 22 as compared with the use of conventional rising and connecting conductors 130, which can be seen in FIG. 2, which typically extend above electrolytic cell 110 into the longitudinal central portion of electrolytic cell 110. This helps to reduce manufacturing costs. It is also noted that the horizontal part 34 of support 30 is supported and connected at each of the two longitudinal edges 38 of each electrolytic cell 10.

In this way, the anode assembly is no longer supported and electrically connected above the pot shell and the anodes by means of a superstructure 132, as is the case with electrolytic cells of prior art illustrated in FIG. 2. The electrolytic cells 10 of the aluminum smelter 1 according to this embodiment of the invention are therefore free from superstructure. The absence of a superstructure widens and/or elongates the electrolytic cells 10 in order to benefit from large electrolytic cells 10, as mentioned previously. Such an enlargement or elongation of electrolytic cells 110 of prior art is not possible because of the superstructure 132, since this widening and/or elongation would result in a widening and/or elongation of the superstructure 132 itself, and therefore of the span of the beam between the legs supporting the beam and the weight to be supported by the superstructure 132. There are superstructures comprising one or more intermediate arches supporting the beam, but such intermediate arches extending transversely above the pot shell 112 and the anodes 118 are bulky and render operations on the cells, in particular the changing of anodes, complex.

The ability to increase the dimensions of the electrolytic cells, combined with an increase in the intensity of the electrolysis current IE, without creating MHD instability due to the particular magnetic configuration of the aluminum smelter 1 according to the invention described in more detail below, makes it possible to substantially improve the performance of the aluminum smelter 1 in comparison with prior art.

The electrical conductors of the aluminum smelter 1 (in particular rising and connecting electrical conductors 22, support 30, cathodic outputs 20, routing conductors 24, electrical conductors of the first and second electrical compensating circuits 4, 6) are indeed configured to obtain effective compensation of the horizontal and vertical components of the magnetic field generated by the circulation of the electrolysis current IE and, in so doing, a limitation of MHD instability, and therefore improved efficiency.

More particularly, the distribution of the electrolytic current IE flowing through rising and connecting electrical conductors 22 is asymmetric between the upstream 22A and downstream 22B rising and connecting electrical conductors. The electrolysis current IE is divided into an upstream electrolysis current IEA, which runs through the set of upstream rising and connecting electrical conductors 22A of the electrolytic cells 10, and a downstream electrolysis current IEB, which runs through all the downstream rising and connecting electrical conductors 22B of electrolytic cells 10. The intensity of upstream electrolysis current IEA is]50-100[% of the intensity of electrolysis current IE, while the intensity of the downstream electrolysis current IEB is]0-50[% of the intensity of electrolysis current IE, noting that the upstream IEA and downstream IEB electrolysis currents are complementary, i.e. the total intensities of the upstream IEA and downstream IEB electrolysis currents is equal to the intensity of the electrolysis current IE.

This asymmetrical distribution with predominance of the upstream relative to the downstream is particularly advantageous when the electrolytic cells 10 of the aluminum smelter are electrolytic cells of large dimensions. The upstream/downstream asymmetry of electrolysis current IE avoids having to resort to an excessive increase in section of the routing conductors 24 under electrolytic cell 10, so that material savings and space are made, without prejudice to the magnetic stability of the electrolytic cell 10.

The choice of distribution between upstream and downstream electrolysis current intensities IEA, IEB is made by means of an economic study. This choice depends mainly on the distance between two cells and the height of the cells. This distribution is carried out by adjusting the sections of the electrical conductors of the upstream and downstream electrical circuits, taking into account their length.

Rising and connecting conductors 22 extend substantially vertically, preferably only vertically, so that the path of the electrolysis current IE through rising and connecting conductors 22 generates a magnetic field with only horizontal components, but no vertical component.

Similarly, the second portion 36 of support 30 of anode assembly 14, and/or cathodic outputs 20 advantageously extend in a vertical direction, and preferably only vertically, so that the path of the electrolysis current IE through this second portion 36 and/or through the cathodic outputs 20 generates a magnetic field with only horizontal components, but no vertical component.

It will be noted that the cathode outputs 20 advantageously pass through the bottom of pot shell 12. The fact of having cathode outputs 20 through the bottom, instead of cathode outputs on the sides of the electrolytic cell, as in prior art (FIG. 2) reduces the length of the routing conductors 24. The reduction in length of the routing conductors 24 allows a further saving of raw materials, a substantial reduction of horizontal currents in the liquids, and thereby improved MHD stability.

Furthermore, also in order to effectively compensate for the magnetic field created by the flow of the electrolysis current IE, the first portion 34 of support 30 of anode assembly 14 extends, preferably only, substantially horizontally and parallel to the transverse direction X of electrolytic cells 10.

Similarly, routing conductors 24 advantageously extend substantially straight and parallel to the transverse direction X of electrolytic cells 10, as far as rising and connecting conductors 22 of the next electrolytic cell 10. This limits the cost of routing electrical conductors 24, by minimizing their length. It also limits the magnetic fields generated by these electrical routing conductors 24 with respect to prior art, and particularly with respect to self-compensated electrolytic cells of prior art.

The rising and connecting electrical conductors 22 are preferably distributed at regular intervals over substantially the entire length of the longitudinal edge 38 to which they are adjacent. In other words, the same distance separates two consecutive rising and connecting electrical conductors 22 in the longitudinal direction Y. This improves the equilibrium of the longitudinal horizontal component of the magnetic field (i.e. that parallel to the length of the electrolytic cell 10).

The upstream rising and connecting electrical conductors 22A and the downstream rising and connecting electrical conductors 22B may be located equidistant from a longitudinal median YZ plane of each electrolytic cell 10, i.e. a plane substantially perpendicular to the transverse direction X and separating each electrolytic cell 10 into two substantially equal parts. In other words, the upstream rising and connecting conductors 22A are at the same distance from this longitudinal median plane YZ as the downstream electrical conductors 22B. In addition, the upstream rising and connecting conductors 22A are advantageously arranged substantially symmetrically to the downstream rising and connecting conductors 22B, with respect to this longitudinal median plane YZ. The advantageous substantially antisymmetrical characteristic of the distribution of the horizontal magnetic field in the liquids is therefore further improved.

To limit the magnetic field generated by the flow of the electrolysis current through the rising and connecting electrical conductors 22, these rising and connecting electrical conductors advantageously extend above the liquid (electrolytic bath) at a height h between 0 and 1.5 meters. The length of the rising and connecting conductors 22 is in this way greatly decreased relative to the rising and connecting conductors 130 of conventional type which extend to heights greater than two meters for electrolytic cells 130 of prior art.

To improve the compactness of the aluminum smelter 1 and limit the costs of raw materials, the upstream rising and connecting conductors 22A of electrolytic cells 10 may be in a staggered arrangement relative to the downstream rising and connecting conductors 22B of the previous electrolytic cell 10 in row 2. This makes it possible to bring the electrolytic cells 10 as close as possible to each other, either to have more electrolytic cells 10 in series over a same distance, which increases performance, or to reduce the length of a row 2 of electrolytic cells 10, thereby gaining space and making even more structural savings.

For effective compensation of the horizontal components of the magnetic field generated by the flow of the electrolysis current IE, i.e. to have horizontal antisymmetric components, the first portion 34 of support 30 of anode assembly 14 and the second portion 36 of support 30 of anode assembly 14 are configured so that the intensity of the fraction of electrolysis current running through an upstream half of this second portion 36 is substantially equal to the intensity of the fraction of electrolysis current running through a downstream half of this second portion 36. In other words, and as shown in FIG. 8, the intensity of the portion of the electrolysis current running through all the stubs located upstream of a longitudinal center plane YZ of electrolytic cell 10 is substantially equal to the intensity of the fraction of the electrolysis current passing through all the stubs located downstream of this longitudinal center plane YZ. In particular, as is apparent from segment S9 of FIG. 8 read in conjunction with the table in FIG. 9, a portion of the upstream electrolysis current IEA goes as far as the stubs located downstream of the median plane YZ of electrolytic cell 10. This is achieved through global electrical balancing of the various sections of conductors.

The principle of magnetic compensating or balancing of aluminum smelter 1 according to the invention makes it possible to obtain for aluminum smelter 1 a circuit of conductors that can be made in modular fashion, as shown in FIG. 7. Each module M may for example comprise an electrical conductor of the first compensating electrical circuit 4 and a particular number of routing conductors 24 and rising and connecting conductors 22 associated with each electrolytic cell 10. The fact is that the electrical conductors included in each module M (rising and connecting conductors 22, anode assembly 14, cathode 16, cathode conductors 18, cathode outputs 20, routing conductors 24, electrical conductors of the first compensating circuit 4) are configured to generate the same predetermined magnetic configuration. In other words, the electrical conductors of each module M are arranged and traversed by currents such that each module M generates the same vertical and horizontal components of magnetic field.

The circuit of conductors, and therefore each electrolytic cell 10, may be composed of a number N of modules M, determining the length of the electrolytic cells 10 and the current flowing through the electrolytic cells 10 (the intensity of the electrolysis current IE flowing through the series of electrolytic cells being equal to the intensity of the portion of the electrolysis current running through each module M multiplied by the number N of modules M).

It is important to note that, in view of the magnetic configuration of each module M, the choice of the number N of modules M per electrolytic cell 10, compensated for by the secondary compensating circuit 6 on the cell ends, only slightly disturbs the magnetic balance of electrolytic cells 10. This makes it possible to obtain an optimal magnetic configuration, for amperages above 1000 kA or even 2000 kA when designing or extending the length of electrolytic cells 10 by the addition of such modules. In contrast, the elongation of electrolytic cells of the self-compensated type or compensated for by compensating magnetic circuits arranged on the sides of cells known from prior art makes it necessary to completely redesign the conductor circuits. The ratio of the quantity of material forming the circuit of conductors to the production surface area of electrolytic cells 10 is not worsened when the electrolytic cells 10 are elongated; it increases in proportion to the number N of modules M and the current intensity passing through the electrolytic cells 10. The electrolytic cells 10 can therefore be elongated simply in relation to need, and the intensity of the current passing through them is not restricted. The modular design of the electrical conductors of electrolytic cells 10 therefore offers an advantage in terms of scalability, since the modular design, combined with a simple adjustment of the amperage of the secondary compensation circuit, means that electrolytic cells 10 can be changed without affecting their magnetic and electrical balancing.

The table in FIG. 9 in conjunction with FIG. 8, shows a module for the intensities flowing through the different electrically conductive elements of the electrolytic cells 10, the conductive elements being symbolized by segments: S1 for upstream rising and connecting conductors 22A; S2, S5 and S8 for the first portion 34 of support 30; S3 and S9 for the second portion 36 of support 30, the anode(s) 32, the electrolytic bath, the aluminum layer 40, the cathode 16, the cathode conductors 18 and the cathode outputs 20; S4, S6 and S10 for routing conductors 24; S7 for the downstream rising and connecting conductors 22B.

The sum of the currents i and i is as shown in the table in FIGS. 9, 13 and 14 is equal to the intensity of the upstream electrolysis current IEA divided by the number N of modules of electrolytic cell 10; intensity ib equals the intensity of the downstream electrolysis current IEB divided by the number N of modules of electrolytic cell 10; the sum of ia and ib is equal to i; the sum of the upstream and downstream electrolysis currents IEA, IEB is therefore equal to 2i multiplied by the number N of modules; and the intensity of the electrolysis current IE flowing through the series of electrolytic cells is equal to the sum of the intensity of the upstream electrolysis current IEA crossing the entire upstream portion of the electrolytic cell and the intensity of the downstream electrolysis current IEB crossing the entire downstream portion of the electrolytic cell, i.e. the product of 2*i* and the number N of electrolytic cell modules.

FIGS. 10 to 12 are schematic wiring diagrams of the electric circuit traversed by the electrolysis current in a module of an electrolytic 10 cell of aluminum smelter 1, and showing for this electrolytic cell 10 the three main zones P1, P2, P3 generating a significantly interfering magnetic field: an upstream zone P1, a central intermediate zone P2, and a downstream zone P3 symmetrical with the upstream zone P1 along a longitudinal median plane YZ of electrolytic cells 10.

The table in FIG. 13, in conjunction with FIGS. 10, 11 and 12 schematically shows the vertical component of the magnetic field generated by the electrical conductors (schematically represented by segments) of the electrolytic cell 10, in the three zones P1, P2, P3 respectively of electrolytic cells 10, by the first and second compensating circuits 4, 6. By summing the contributions of each of the electrical conductors, and that of the first and second compensating circuit 4, 6, it is noted that the vertical component Bz of the magnetic field generated by the flow of the electrolysis current is zero, i.e. perfectly compensated for. In this way MHD instabilities are minimized; this makes it possible to substantially improve performance.

In addition, the table in FIG. 14, also in conjunction with FIGS. 10, 11 and 12 schematically shows the horizontal longitudinal component of the magnetic field generated by the flow of the electrolysis current through the electrical conductors (symbolized by segments) of electrolytic cell 10, zone by zone, and through the first and second compensating circuits 4, 6. The transverse horizontal component of the magnetic field is itself antisymmetric because the conductors are symmetrical along plane XZ. By summing the contributions of each segment, and those of the first and second compensating circuits 4, 6, it can be seen that the longitudinal horizontal component By of the magnetic field is antisymmetric (opposite in zones P1, P3 upstream and downstream, and zero in the central zone P2). This antisymmetry eliminates deleterious effects due to the horizontal components of the magnetic field.

The first electric compensating circuit 4 is described in more detail below.

The first compensating circuit 4 extends under electrolytic cells 10. This first electrical compensating circuit 4 is designed to be traversed by a first compensating current IC1 in the opposite direction to the direction of overall flow of the electrolysis current IE, as can be seen in FIGS. 5 and 7. It will be recalled that the direction of overall flow of the electrolysis current IE means the direction of flow of electrolysis current IE across the aluminum smelter 1 or the row(s) 2 of electrolytic cells 10.

The first electric compensating circuit 4 comprises electric conductors which may be metal bars, for example made of aluminum, copper or steel, or, advantageously, electrical conductors made of superconducting material, the latter helping to reduce energy consumption and, because of their mass which is lower than the equivalent metal conductors, to reduce the costs of structures to support or protect them from any molten metal using metal deflectors 42 (FIG. 7) or by burying them. Advantageously, these electrical conductors made of superconducting material may be arranged so as to make several turns in series beneath the row or rows of cells as described in patent application WO2013007893 in the name of the applicant.

Aluminum smelter 1 comprises a power station 44 configured to cause to flow through the first compensating electrical circuit 4 a current of intensity IC1 equal to twice the intensity of the downstream electrolysis current IEB to the nearest 20%, and preferably to the nearest 10%.

This power station 44 may be a separate electrical supply station, i.e. separate from the power station 8 powering electrolytic cells 10 with electrolysis current IE. The power station 44 of the first compensating circuit 4 is exclusively dedicated to powering the first compensating circuit 4.

The first compensating circuit 4 is in this way also independent of the main electrical circuit traversed by electrolysis current IE notably including the row(s) 2 of electrolytic cells 10. If the first electric compensating circuit 4 sustains damage, for example one of the electrolytic cells 10 being pierced by the liquid contained in the electrolytic cells, the temperature of which is close to 1,000° C., the electrolysis reaction can continue, but with a lower yield because the magnetic compensation has been impacted. In addition, the intensity of the first compensating current IC1 is can be modified independently of the electrolysis current IE. This is of essential importance in terms of scalability and adaptability. Partly because if the intensity of the electrolysis current is increased during the lifetime of the aluminum smelter 1, the magnetic compensation can be adjusted to this change by varying the intensity of the first compensating current IC1 as necessary. Also because the intensity of the first compensating current IC1 can be adjusted to the characteristics and quality of the alumina available. In this way the velocities of MHD flows can be controlled to encourage or reduce stirring of the liquids and dissolution of alumina in the bath on the basis of the characteristics of the alumina available, which ultimately helps to provide the best possible performance in the light of alumina supplies.

The electrical conductors of the first electric compensating circuit 4 extend under the electrolytic cells together forming a layer of parallel electrical conductors, advantageously two to twelve, preferably three to ten parallel electrical conductors. In other words, in the longitudinal section of an electrolytic cell 10, i.e. in a longitudinal plane YZ of the electrolytic cell 10, as shown in FIG. 7, the first electrical compensating circuit 4 extends under several parts of the electrolytic cell 10. It will be noted that the first compensating current IC1 flows in the opposite direction to the overall direction of flow of the electrolysis current IE, through all of the electrical conductors forming the layer. The layer may be formed by the same electric circuit forming several turns or loops in series under the electrolytic cells 10, each loop corresponding to an electrical conductor of the layer. Alternatively, the layer may be formed by division into a bundle of parallel electrical conductors of the first electric compensating circuit 4, the latter may optionally form a single loop under the electrolytic cells 10.

The intensity of the first compensating current IC1 is equal to the sum of the compensating current intensities flowing through each electrical conductor of the layer. Preferably, the intensity of the first compensating current IC1 in each electrical conductor of the layer is equal to the intensity of the first compensating current IC1 divided by the number of electrical conductors of this layer.

The electrical conductors of the layer are preferably equidistant from each other. The same distance therefore separates two adjacent electrical conductors of the layer. Compensation for the unfavorable magnetic field is therefore further improved.

The electrical conductors of the layer may extend in parallel with each other. They preferably extend parallel to the transverse direction X of electrolytic cells 10 Furthermore, the electrical conductors forming the layer may be all be arranged in the same horizontal plane XY. This also improves compensation of the magnetic field generated by the flow of the electrolysis current.

In addition, the electrical conductors of the layer may extend substantially symmetrically relative to the transverse median plane XZ of the electrolytic cells, i.e. with respect to the plane perpendicular to the longitudinal direction Y, this plane separating the electrolytic cells 10 into two substantially equal halves.

According to the example in FIG. 7, the first electrical compensation circuit 4 forms a layer of three substantially equidistant conductors arranged in the same substantially horizontal plane XY. This layer includes as many electrical conductors as the electrolytic cell 10 has modules M.

In fact, the layer is advantageously configured so that each module M of electrolytic cell 10 comprises the same number of electrical conductors of the first electric compensating circuit 4. This makes it possible to obtain a compensation for the magnetic field per module, which produces better effects and offers a significant advantage in terms of implementation and scalability.

The second electric compensating circuit 6 is described in more detail below.

The second electric compensating circuit 6 extends over at least one transverse side of electrolytic cells 10, substantially parallel to the transverse direction X of electrolytic cells 10, i.e. parallel to the row(s) 2 of electrolytic cells 10. The second electric compensating circuit 6 is designed to be traversed by a second compensating current IC2 in the same direction as the direction of overall flow of the electrolysis current IE.

Preferably, the second electric compensating circuit 6 extends along both transverse sides of the electrolytic cells 10, as illustrated in FIG. 5. In this case, inner loop 61 denotes the electrical conductors of the second electrical compensating circuit 6 which are situated between the first two rows 2 of adjacent electrolytic cells 10, and outer loop 62 denotes the electrical conductors of the second electrical compensating circuit 6 which are situated outside of the rows 2 of electrolytic cells 10, i.e. which are on the other side of the electrolytic cells 10 with respect to the electrical conductors forming the inner loop 61. The inner loop 61 is traversed by a second compensating current IC21 and the outer loop 62 is traversed by a second compensating current IC22. The second compensating currents IC21 and IC22 flow in the same direction. The sum of currents IC21 and IC22 flowing in the inner loop 61 and outer loop 62 respectively is equal to the compensating current IC2. The inner loop 61 and/or the outer loop 62 may possibly make several turns in series; where appropriate, the intensity of the current IC21, IC22 respectively, is the product of the number of turns in series by the current flowing in each turn in series.

The aluminum plant 1 comprises a power station 46 which is preferably configured to flow through the second electrical compensating circuit 6 (inner loop 61 and/or outer loop 62) a total intensity (as appropriate inner loop 61 plus outer loop 62) of compensating current IC2 between 50% and 100% of the intensity difference between the upstream and downstream electrolysis currents, and preferably between 80% and 100% of the intensity difference between the upstream and downstream electrolysis currents. This intensity value, determined according to the unsymmetrical distribution of the electrolytic current IE in each electrolytic cell 10, provides, in synergy with the choice of the asymmetrical distribution value IEA, IEB and the intensity of the first compensating current IC1, the best magnetic field compensation results, effectively applicable to large electrolytic cells 10.

Preferably, the intensity of current IC21 flowing in the inner loop 61 differs from the current intensity IC22 flowing in the outer loop 62. More specifically, the intensity of the current IC21 flowing through the inner loop 61 is advantageously greater than the intensity of current IC22 flowing in the outer loop 62.

The current flowing through the inner loop 61 may be increased to compensate for the impact of the neighboring row on the vertical magnetic field. This increase will have a typical value close (to the nearest 50%) to IE2×D61/DP2 where IE2=IE−IC1+IC2=IE+IEA−3 IEB and DP2 is the distance from the neighboring row to the center of the cell and D61 is the distance from the inner loop 61 to the center of the cell. For a conventional electrolysis series IE2 is greater than or equal to IE. It may be noted that IE+IEA−3 IEB is much lower than IE. This is a gain provided by this design that makes it possible to bring the neighboring row closer since the creation of the magnetic field by the neighboring row is much lower without any additional cost compared to what is known by those skilled in the art.

The power station 46 powering the second compensating circuit 6 may be a separate power supply station, i.e. separate from power station 8 powering electrolytic cells 10 with electrolysis current IE and distinct from power station 44 supplying the first electric compensating circuit 4. The power station 46 of the second compensating circuit 6 is therefore exclusively dedicated to powering the second compensating circuit 6. The second compensating circuit 6 is in this way also independent of the main electrical circuit traversed by electrolysis current IE. The intensity of the second compensating current IC2 is modifiable independently of electrolysis current IE, offering substantial advantages in terms of scalability and adaptability of the aluminum smelter 1, as explained above concerning the first compensating electrical circuit 4. Advantageously, the second compensating circuit 6 can also be separate from the first compensating circuit 4.

When the second compensating electrical circuit 6 extends on both sides of electrolytic cells 10, the electrical conductors forming the second electrical compensating circuit 6 may advantageously be symmetrical with respect to a median transverse plane XZ of electrolytic cells 10. This improves compensation of the adverse magnetic field.

Moreover, still with a view to effectively compensating for this magnetic field, created by the circulation of electrolysis current IE, the electrical conductors of the second compensating circuit 6 advantageously extend in the same horizontal plane XY. Preferably, this XY horizontal plane is located at the height of the layer of liquid aluminum 40 formed within electrolytic cells 10 during the electrolysis reaction.

It will be noted that the electrical conductors forming the second electrical compensating circuit 6 may advantageously be configured to limit "end-of-row" effects, as shown in FIG. 5.

The electrical conductors forming the second electric compensating circuit 6 may be metal bars, for example made of aluminum, copper or steel, or, advantageously, electrical conductors made of a superconducting material, the latter to reduce energy consumption and, because of their lower mass than equivalent conductors made of metal, to reduce the costs of structures to support them. Advantageously, these electrical conductors made of superconducting material may be arranged so as to make several turns in series on the side(s) of rows 2 of electrolytic cells 10 as described in patent application WO2013007893 in the name of the applicant.

The invention also relates to a method of compensating for a magnetic field created by the flow of an electrolysis current IE in the electrolytic cells 10 of an aluminum smelter 1 having the above characteristics. This method comprises:

- the fact of having the first compensating current IC1 flow through the first compensating circuit 4 in the opposite direction to the overall flow direction of electrolysis current IE,
- the fact of having the second compensating current IC2 flow through the second compensating circuit 6 in the same direction as the overall flow direction of electrolysis current IE.

The method also advantageously includes the fact of asymmetrically dividing the electrolysis current IE between the upstream rising and connecting electrical conductors 22A and the downstream rising and connecting electrical conductors 22B.

This step of asymmetrical distribution of the electrolysis current between the upstream and the downstream of the electrolytic cells 10 includes separating the electrolysis current IE into an upstream electrolysis current IEA, flowing through all the upstream electrical rising and connecting conductors 22A of each electrolytic cell 10, so that the intensity of the upstream electrolysis current IEA is between]50-100[% of the intensity of the electrolysis current IE, and a downstream electrolysis current IEB, flowing through all of the downstream electrical rising and connecting conductors 22B of each electrolytic cell 10, so that the intensity of the downstream electrolysis current IEB is between]0-50[% of the intensity of the electrolysis current IE, the sum of the intensities of the upstream and downstream electrolysis currents IEA, IEB being equal to the intensity of the electrolysis current IE.

The step involving circulating the first compensating current IC1 is advantageously such that the intensity of the first compensating current IC1 is equal to twice the intensity of the downstream electrolysis current IEB, to the nearest 20%, and preferably to the nearest 10%.

The step involving circulating the second compensating current IC2 is advantageously such that the total intensity (inner loop 61+outer loop 62) of the second compensating current IC2 is between 50% and 100% of the intensity difference between the upstream IEA and downstream IEA electrolysis current IEB, and preferably between 80% and 100% of the intensity difference between the upstream and downstream electrolysis currents.

For these intensity values of the upstream electrolysis current IEA, of the downstream electrolysis current IEB, the first compensating current IC1 and the second compensating current IC2, the applicant found that the magnetic field generated by the flow of the electrolysis current is most effectively compensated.

Furthermore, the intensity of current IC21 flowing in the inner loop 61 may differ from the current intensity IC22 flowing in the outer loop 62. More specifically, the intensity of the current IC21 flowing through the inner loop 61 is advantageously greater than the intensity of current IC22 flowing in the outer loop 62.

Furthermore, the method may advantageously comprise a step of analyzing at least one characteristic of the alumina in at least one of the electrolytic cells 10 in the aluminum smelter 1 described above, and determining a distribution of current intensity values for the upstream and downstream electrolysis currents IEA, IEB to be made to flow based on this analyzed characteristic, which also defines as appropriate the intensity values of the first and second compensating currents IC1, IC2 and as appropriate the upstream and downstream electrolysis current IEA, IEB. The intensity values of the first and second compensating currents IC1, IC2, and as appropriate the upstream and downstream electrolysis currents IEA, IEB, can then be modified to the values previously determined if the intensity values of the first and second compensating currents IC1, IC2 and the upstream and downstream electrolysis currents IEA, IEB differ from the initial values determined. In this way, the process makes it possible to change the magnetic compensation in order to increase or decrease the mixing of liquids while controlling MHD instabilities. Generally, the greater the mixing (or flow) of liquids, the more effective the dissolution of alumina, but the more unstable the bath/metal interface (=MHD instability), which can be detrimental to the performance of the cells. Such a process is particularly advantageous with the configuration of the electrical conductors described above because it makes the electrolytic cells 10 magnetically very stable and therefore provides greater range for modulating/optimizing mixing depending on the quality of the alumina. The analyzed characteristics of the alumina may in particular be the ability of the alumina to dissolve in the bath, the fluidity of the alumina, its solubility, its fluorine content, its moisture content, etc.

Determining a distribution of intensity values of the upstream and downstream compensating currents IEA, IEB and/or the intensity values of the first and second compensating currents IC1, IC2 based on the analyzed characteristics of alumina may be carried out using a nomograph, for example made by a person skilled in the art, by calculation, experimentation and documentation of the best correspondences between intensities of the upstream and downstream electrolysis currents IEA, IEB and the characteristics of the alumina. This is a question of quantifying the intensity of the desired mixing of liquids in relation to the level of MHD instabilities.

It may happen that the alumina available for continuous operation of the aluminum smelter is of different quality, in particular more or less pasty, and thus has different abilities to dissolve in the electrolysis bath. In this case, movement of the liquids in the electrolytic cells 10 is an advantage because it can be used to stir this alumina to encourage it to dissolve. Now in the case of self-compensation in particular (used in prior art) the magnetic field giving rise to movement of the liquids is directly compensated for by the electrolysis current itself, with a distribution of the magnetic field imposed and fixed by the path of the linking conductors. In aluminum smelters where there is self-compensation it is therefore not possible to introduce a deliberate and temporary imbalance in the compensation for the magnetic field to increase the intensity with which the alumina is stirred in the cells with a view to increasing the efficiency of dissolution. So when the only alumina available is alumina which has greater than normal difficulty in dissolving, the performance of aluminum smelters with self-compensation may be substantially affected.

Naturally, the invention is in no way limited to the embodiment described above, as this embodiment is provided only as an example. Modifications are possible, in particular from the point of view of the constitution of the various components, or the substitution of equivalent techniques, without thereby going beyond the scope of protection of the invention. In this way, the present invention is for example compatible with the use of anodes of the "inert" type at the level of which oxygen is formed during the electrolysis reaction.

The invention claimed is:

1. Aluminum smelter comprising at least one row of electrolytic cells arranged transversely in relation to a length of said at least one row, a first electrolytic cell of the row of electrolytic cells comprising anode assemblies and rising and connecting electrical conductors to the anode assemblies, characterized in that the rising and connecting electrical conductors extend upwardly along two opposite upstream and downstream longitudinal edges of the first electrolytic cell for conducting electrolysis current to the anode assemblies, and in that the aluminum smelter includes:

at least one first electrical compensation circuit extending beneath the electrolytic cells, said at least one first electrical compensation circuit being configured to be traversed by a first compensation current designed to flow under the electrolytic cells in an opposite direction to a global direction of flow of the electrolysis current, at least one second electric compensation circuit extending over at least one side of said at least one row of electrolytic cells, said at least one second electric compensation circuit being configured to be traversed by a second compensation current designed to flow in a same direction as the global direction of flow of the electrolysis current.

2. Aluminum smelter according to claim 1 in which the rising and connecting electrical conductors comprise upstream rising and connecting electrical conductors, adjacent to the upstream longitudinal edge of the first electrolytic cell, and downstream rising and connecting electrical conductors, adjacent to the downstream longitudinal edge of the first electrolytic cell, and the aluminum smelter is laid out so that a distribution of the electrolysis current is asymmetrical between the upstream and downstream rising and connecting electrical conductors, an intensity of an upstream electrolysis current designed to run through all of the rising and connecting electrical conductors upstream of the first electrolytic cell being equal to 50-100% of an overall intensity of the electrolysis current, and an intensity of a downstream electrolysis current designed to run through all of the rising and connecting electrical conductors downstream of the first electrolytic cell is equal to 0-50% of the overall intensity of the electrolysis current, a total intensity of the upstream and downstream electrolysis currents being equal to the overall intensity of the electrolysis current.

3. Aluminum smelter according to claim 2 in which the aluminum smelter comprises a power station configured to cause to flow through said at least one first compensation electrical circuit a first compensating current of intensity equal to twice the intensity of the downstream electrolysis current (IEB) to the nearest 20%.

4. Aluminum smelter according to claim 2 in which the aluminum smelter includes a power station configured to cause to flow through said at least one second electrical compensation circuit the second compensation current of an intensity between 50% and 100% of a difference in intensity between the upstream and downstream electrolysis currents.

5. Aluminum smelter according to claim 1 in which the rising and connecting electrical conductors are distributed at regular intervals along the upstream and downstream longitudinal edges of the first electrolytic cell to which the rising and connecting electrical conductors are adjacent.

6. Aluminum smelter according to claim 1 in which the rising and connecting electrical conductors along the upstream and downstream longitudinal edges are equidistant from a longitudinal central plane of the first electrolytic cell.

7. Aluminum smelter according to claim 6 in which the rising and connecting electrical conductors along the upstream and downstream longitudinal edges are arranged substantially symmetrically relative to said longitudinal central plane of the first electrolytic cell.

8. Aluminum smelter according to claim 1 in which said at least one first electrical compensation circuit includes electrical conductors extending under the electrolytic cells together forming a layer made up of a plurality of parallel electrical conductors.

9. Aluminum smelter according to claim 8 in which the electrical conductors of said layer are arranged at regular intervals from each other along a longitudinal direction of the electrolytic cells.

10. Aluminum smelter according to claim 8 in which the electrical conductors of said layer are arranged substantially symmetrically with respect to a transverse median plane of the electrolytic cells.

11. Aluminum smelter according to claim 8 in which the electrical conductors of said layer are arranged in a same horizontal plane.

12. Aluminum smelter according to claim 8 in which said at least one second electric compensation circuit includes electrical conductors extending from each side of said at least one row of electrolytic cells, and the second compensation current flows in the same direction as the global direction of flow of the electrolysis current on each side of the electrolytic cells.

13. Aluminum smelter according to claim 12 in which an intensity of an inner second compensation current flowing in an inner loop of said at least one second compensation circuit differs from an intensity of an outer second compensation current flowing in an outer loop of said at least one second compensation circuit.

14. Aluminum smelter according to claim 13 in which the intensity of the inner second compensating current flowing in the inner loop is greater than the intensity of the outer second compensating current flowing in the outer loop.

15. Aluminum smelter according to claim 12 in which the electrical conductors forming the at least one second compensating electrical circuit are substantially symmetrical with respect to a median transverse plane of the electrolytic cells.

16. Aluminum smelter according to claim 12 in which the electrical conductors of the second compensating electrical circuit extend in a same horizontal plane, at a height of a layer of liquid aluminum formed inside the electrolytic cells during an electrolysis reaction.

17. Aluminum smelter according to claim 1 in which said at least one first electric compensation circuit is independent of a main electrical circuit through which the electrolysis current flows.

18. Aluminum smelter according to claim 1 in which said at least one second electric compensating circuit is independent of a main electrical circuit through which the electrolysis current flows.

19. Aluminum smelter according to claim 1 in which the first electrolytic cell is of modular electrical construction in N modules repeated in a direction of length of the first electrolytic cell, each module comprising electrical conductors configured to generate a same predetermined magnetic configuration.

20. Aluminum smelter according to claim 1, characterized in that the at least one first electrical compensation circuit comprises electrical conductors extending beneath the electrolytic cells, and wherein the first compensation current is designed to flow through all of the electrical conductors of the at least one first electrical compensation circuit in the opposite direction to the global direction of flow of the electrolysis current.

21. Method of compensating for a magnetic field created by the flow of an electrolysis current in the aluminum smelter according to claim 1, the method comprising:

causing a flow, in the opposite direction to the global direction of flow of the electrolysis current, of the first compensation current through said at least one first electrical compensation circuit, causing a flow, in the same direction as the global direction of flow of the electrolysis current, of a second compensation current through said at least one second electrical compensation circuit.

22. Method according to claim 21 in which the method comprises causing an asymmetric distribution of the electrolysis current between the upstream and the downstream of the electrolytic cells, an upstream set of the rising and connecting electrical conductors upstream of the electrolytic cells being traversed by an upstream electrolysis current of an intensity between 50-100% of an overall intensity of the electrolysis current, and a downstream set of the rising and connecting electrical conductors downstream of the electrolytic cells being traversed by a downstream electrolysis current of an intensity between 0-50% of the overall intensity of the electrolysis current, a sum of the intensities of the upstream and downstream electrolysis currents being equal to the overall intensity of the electrolysis current.

23. Method according to claim 22 in which an intensity of the first compensating current is equal to twice the intensity of the downstream electrolysis current, to the nearest 20%.

24. Method according to claim 22 in which an intensity of the second compensating current is between 50% and 100% of a difference in intensity between the upstream and downstream electrolysis currents.

25. Method according to claim 21 in which said at least one second electric compensating circuit comprises an inner loop and an outer loop, and wherein an intensity of a second inner compensating current flowing in the inner loop is different from an intensity of a second outer compensating current flowing in the outer loop.

26. Method according to claim 25 in which the intensity of the second inner compensating current flowing in the inner loop is greater than the intensity of the second outer compensating current flowing in the outer loop.

27. Method according to claim 21 in which the method comprises analyzing at least one characteristic of alumina in at least one of the electrolytic cells of said aluminum smelter, and determining intensity values of the first compensating current and the second compensating current to be made to flow as a function of said at least one characteristic analyzed.

* * * * *